US006833804B2

(12) United States Patent
Atar

(10) Patent No.: US 6,833,804 B2
(45) Date of Patent: Dec. 21, 2004

(54) OPERATION OF A DECOY AGAINST THREATS

(75) Inventor: Doron Atar, Kiryat Yam (IL)

(73) Assignee: Rafael - Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/341,969

(22) Filed: Jan. 14, 2003

(65) Prior Publication Data

US 2004/0227657 A1 Nov. 18, 2004

(30) Foreign Application Priority Data

Feb. 4, 2002 (IL) ..... 147 984

(51) Int. Cl.[7] ..... H01Q 15/20
(52) U.S. Cl. ..... 342/10; 342/8; 342/9; 89/1.11
(58) Field of Search ..... 89/1.11; 342/5, 342/10, 8, 9

(56) References Cited

U.S. PATENT DOCUMENTS

| | | | | |
|---|---|---|---|---|
| 3,568,191 A | | 3/1971 | Hister et al. | |
| 3,671,965 A | | 6/1972 | Rabenhorst et al. | |
| 4,063,515 A | * | 12/1977 | Schneider et al. | 102/505 |
| 4,286,498 A | * | 9/1981 | Block et al. | 86/1.1 |
| 4,695,841 A | | 9/1987 | Billard | |
| 5,398,032 A | | 3/1995 | Tucker et al. | |
| 5,814,754 A | * | 9/1998 | Mangolds | 89/1.11 |

FOREIGN PATENT DOCUMENTS

| | | | |
|---|---|---|---|
| CA | 1238400 | | 6/1988 |
| FR | 2723263 A | | 2/1996 |
| GB | 2189079 | | 10/1987 |
| JP | 54-100199 | * | 8/1979 |
| NL | 8403952 A | | 7/1986 |

OTHER PUBLICATIONS

Vic Pheasant, "Advances in Passive Expendable Countermeasures", Journal of Electronic Defense, pp. 41–46, May 1998.

Heinz–Dieter Hanses, Anti–Ship Missiles (ASM) and Countermeasures (Part II ASMD), Naval Forces, pp. 10–21 Feb. 2001.

IDS 300, Irvin Aerospace Ltd., of Icknield Way, Letchworth, Hertfordshire, Great Britain SG6 1EU, 2 pages. No date.

* cited by examiner

*Primary Examiner*—Stephen M. Johnson
(74) *Attorney, Agent, or Firm*—Frishauf, Holtz, Goodman & Chick, P.C.

(57) ABSTRACT

A Radar Counter Measure System (RCMS) and method for operating a decoy as a Radar Counter Measure (RCM) against incoming airborne threats, wherein the RCMS consists of an airborne vehicle (6) carrying a payload (8) launched from a platform (2) by a launcher (4). The payload contains one or more decoys. Each decoy includes a folded corner reflector construction (CRC) (14) which is released at a predetermined point on the vehicle's trajectory. The vehicle is launched by a gun (26), a mortar (20), a rocket (32) or another airborne device. Once released, the decoy is deployed and self-erected to become effective as a RCM. The self-erection mechanism (12) is mechanical, pneumatic, pyrotechnic or aerodynamic. The payload (8) may hold various kinds of counter measure devices.

48 Claims, 3 Drawing Sheets

OPERATION OF A DECOY AGAINST THREATS

BACKGROUND

The present invention relates to the operation of decoys against threats and to Electronic Counter Measures, and more specifically to a counter measure utilizing an expendable autonomous airborne vehicle.

Since the last decades, fighting ships are equipped with Electronic Warfare Systems (EWS) and with Radar Counter Measures (RCMs) as a protection against incoming threats such as guided missiles. The significance of the threat imposed by pinpoint precision weapon systems aimed against naval units was vividly demonstrated during the Falkland War. On May 4, 1982, the HMS Sheffield was hit by an AM-39 Exocet missile launched by an Argentine Super-Etendard. After fighting the fire for more than five hours, the ship was abandoned and sank six days later when being towed. A total of 20 crewmen died and 24 were injured. Special attention is therefore wisely devoted to protection against radar-guided missiles and to missiles with radar seekers.

Previous inventions present insight about the state of the art. Canadian Patent No. 1238400, to Arunas Macikunas et al., divulges a land based radar reflector for use in maritime navigation systems. Such passive radar reflectors for navigation in inland waterways, lakes, harbors and the like, are not the intention of the present disclosure.

British Patent No. 2189079, to Barry J. James et al., discloses a passive defense implemented as a floatable decoy that includes an inflatable framework or cage, operative with radar reflective panels. Another floating device, available on the market as IDS 300, is made by Irvin Aerospace Ltd., of Icknield Way, Letchworth, Hertfordshire, Great Britain SG6 1 EU, which sells a naval decoy, set to sea from a ship's deck. It should be considered that at sea, the waves shield the floating decoy from the sight of an incoming enemy threat, whereby the decoy features degraded effectiveness. Moreover, the floating decoy is thrown overboard, thus close to the ship, making it impossible to open a range between the decoy and the ship from the beginning.

Still another version of passive defense RCM is chaff, as described in "Advances in Passive Expendable Countermeasures", by Vic Pheasant in the Journal of Electronic Defense, pp. 41–46, May 1998, and in Anti-Ship Missiles (ASM) and Countermeasures (Part II ASMD), published in Naval Forces, February 2001. Chaff is known since World War II, and is in common use with many naval forces all over the world. Such chaff-dispensing systems are made and sold by Rafael, Armament Development Authority Ltd., Israel, for more than twenty years. These chaff-rockets usually disperse chaff to form a cloud of large dimensions. Nowadays, puffs of chaff are expected to deceive but a decreasing number of seekers equipping modern Anti-Ship Missiles.

However, none of the previously known devices permits to provide complete simulation of a ship. None of them fly a single point RCM on-board of an expendable airborne vehicle for release in mid-air, at a predetermined point, to effectively simulate a target and to thwart an expected or incoming airborne radar threat. The previously mentioned inventions are not configured to counter an incoming radar-homing missile at ranges spanning from great distance to close proximity from the platform to be protected, by a self-erecting single point decoy. Furthermore, these known inventions do not provide threat-alluring decoys for release in mid-air as a single point RCM arranged for self-erection and deployment at a precisely determined point in the sky.

There is thus a widely recognized need for, and it would be highly advantageous to have, an inexpensive RCM operating a quick reaction system, launching an expendable airborne vehicle for the deployment of a self-erecting corner radar decoy structure, as a single point decoy. It is also desirable for the point decoy to feature a large radar cross section, RCS, to effectively simulate a huge target, such as a ship, to achieve luring the enemy away from the real target. In addition, it would be an advantage to deploy the expendable decoy at a predetermined point in mid-air, away from the attacked platform.

SUMMARY

It is an object of the present invention to provide a quick response means for fast reaction to an impending or actual threat using radar.

Another object of the present invention is to provide a point decoy featuring a large radar cross-section, or RCS, effectively simulating a large target.

It is a further object of the present invention to provide an expendable point decoy storable and transportable while kept folded in a minimum space and self-erecting when released.

Yet, another object of the present invention is to provide an autonomous expendable airborne Radar Counter Measure system (RCMS) for protection from a threat guided by or operating in association with radar signals. The RCMS comprises a launching system mounted on a platform, and an airborne vehicle launched in predetermined trajectory by the launching system. The airborne vehicle carries a payload comprising at least one CRC (Corner Reflector Construction) that when deployed, is operationally effective for deception of the threat. The airborne vehicle further comprises a release system for releasing the at least one CRC from the airborne vehicle at a predetermined point P, and a self-erection system for deploying the at least one CRC.

Still another object of the present invention is to provide a control system for management and operation of the RCMS, the control system being selected, alone and in combination, from the group consisting of centralized and distributed control systems. The RCMS has at least one controller to provide management and operation of airborne vehicle functions. Moreover, management and operation of functions of the airborne vehicle, of the release system and of the self-erection system are performed by at least one controller.

An additional object of the present invention is to provide a platform selected from a group consisting of airborne, waterborne, and ground-borne platforms. The platform is thus possibly a marine platform.

One more object of the invention is to provide an airborne vehicle launched in either one of two operating modes comprising firing from an artillery piece and launching as a self-propelled vehicle. Preferably, the airborne vehicle is configured for launch by a rocket motor.

Furthermore, it is an object of the present invention to provide for the release of each one of the at least one CRC, respectively, at one predetermined point P on the trajectory of the airborne vehicle. The predetermined release point P is selected, alone and in combination, from the group consisting of points in space, points in time and points of altitude.

Possibly, each one of the at least one CRC is released at one predetermined point P in time.

There is also provided as an object of the present invention at least one CRC configured to deploy by self-erection of at least one radar reflector to reflect radar signals. The at least one CRC provides a predetermined Radar Cross Section (RCS) when deployed, and comprises at least one multi-directional radar corner reflector, or at least one trihedral radar corner reflector. Preferably, the multi directional radar reflector comprises eight trihedral radar corner reflectors.

It is also an object of the present invention to provided for the at least one CRC to self-erect by application of elastic forces inherent therewithin, or of inflation pressure, or of aerodynamic forces derived from the predetermined trajectory, or of forces derived on-board the airborne vehicle. Possibly, the at least one CRC self-erects by forces derived from pyrotechnic means, or by forces derived from the release system, or by inertia forces, or by forces derived from the environment, or by a combination of forces.

Another object of the present invention is to provide a method of operation of a Quick Response Counter Measure (QRCM) against an airborne radar threat. The method comprising the steps of detecting a radar-guided threat, responding to the detected threat by launching, from a platform, and into predetermined trajectory, of an expendable autonomous airborne vehicle. The airborne vehicle comprises a payload with at least one CRC, that when self-erected, is configured for deception of the radar-guided threat, for flying the payload to a predetermined point of release, for releasing the at least one CRC from the airborne vehicle, and for deploying the at least one CRC to start deception.

It is a further object of the present invention to provide a method for managing and operating the QRCM by a control system selected, alone and in combination, from the group consisting of centralized and distributed control systems. The control system comprises at least one controller to provide management and operation of airborne vehicle functions. Furthermore, management and operation of functions of the airborne vehicle, of the payload release system and of the payload inflation system are performed by at least one controller.

Yet, another object of the present invention is to provide a method wherein the platform comprises airborne, waterborne, and ground-borne platforms. Possibly, the airborne vehicle is launched from a marine platform.

Still another object of the present invention is to provide a method for launching the airborne vehicle that comprises firing the airborne vehicle from an artillery piece and launching thereof as a self-propelled vehicle. The airborne vehicle is preferably configured for launch by a rocket motor.

One more object of the invention is to provide a method comprising the releasing of each one of the at least one CRC, respectively, at one predetermined point P on the trajectory of the airborne vehicle. That predetermined release point P is selected, alone and in combination, from the group consisting of points in space, points in time and points of altitude. Possibly, the at least one CRC is released at one predetermined point P in time.

An additional object of the present invention is to provide a method wherein the at least one CRC is configured to deploy by self-erection of at least one radar reflector to reflect radar signals. When deployed, the at least one CRC is configured to provide a predetermined Radar Cross Section (RCS), and the at least one CRC comprises at least one multi-directional radar corner reflector or at least one trihedral radar corner reflector. Preferably, the multi-directional radar reflector comprises eight trihedral radar corner reflectors.

Furthermore, it is an object of the present invention to provide a method for the at least one CRC to self-erect by application of elastic forces inherent therewithin, or of inflation pressure, or of aerodynamic forces derived from the predetermined trajectory, or of forces derived on-board the airborne vehicle. Possibly, the method comprises at least one CRC that self-erects by forces derived from pyrotechnic means, or by forces derived from the release system, or by inertia forces, or by forces derived from the environment, or by a combination of forces.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DESCRIPTION OF PREFERRED EMBODIMENTS

The present invention discloses a Radar Counter Measure (RCM), for the protection of platforms against incoming threats, such as weapon systems guided by radar towards one or more of those platforms regarded as targets. The RCM is operated when an attack is either expected or detected. There is thus disclosed a RCM comprising a platform with a launcher for the launching of an expendable airborne vehicle in response to, or in expectation of, an incoming enemy attack. The airborne vehicle comprises a payload, which releases at least one self-erecting CRC (Corner Reflector Construction) for delusion of the enemy and of his weapon systems. The self-erection deploys at least one Corner Radar Reflector, which operates to deceive the single or many hostile attacking weapons.

Figure 1:
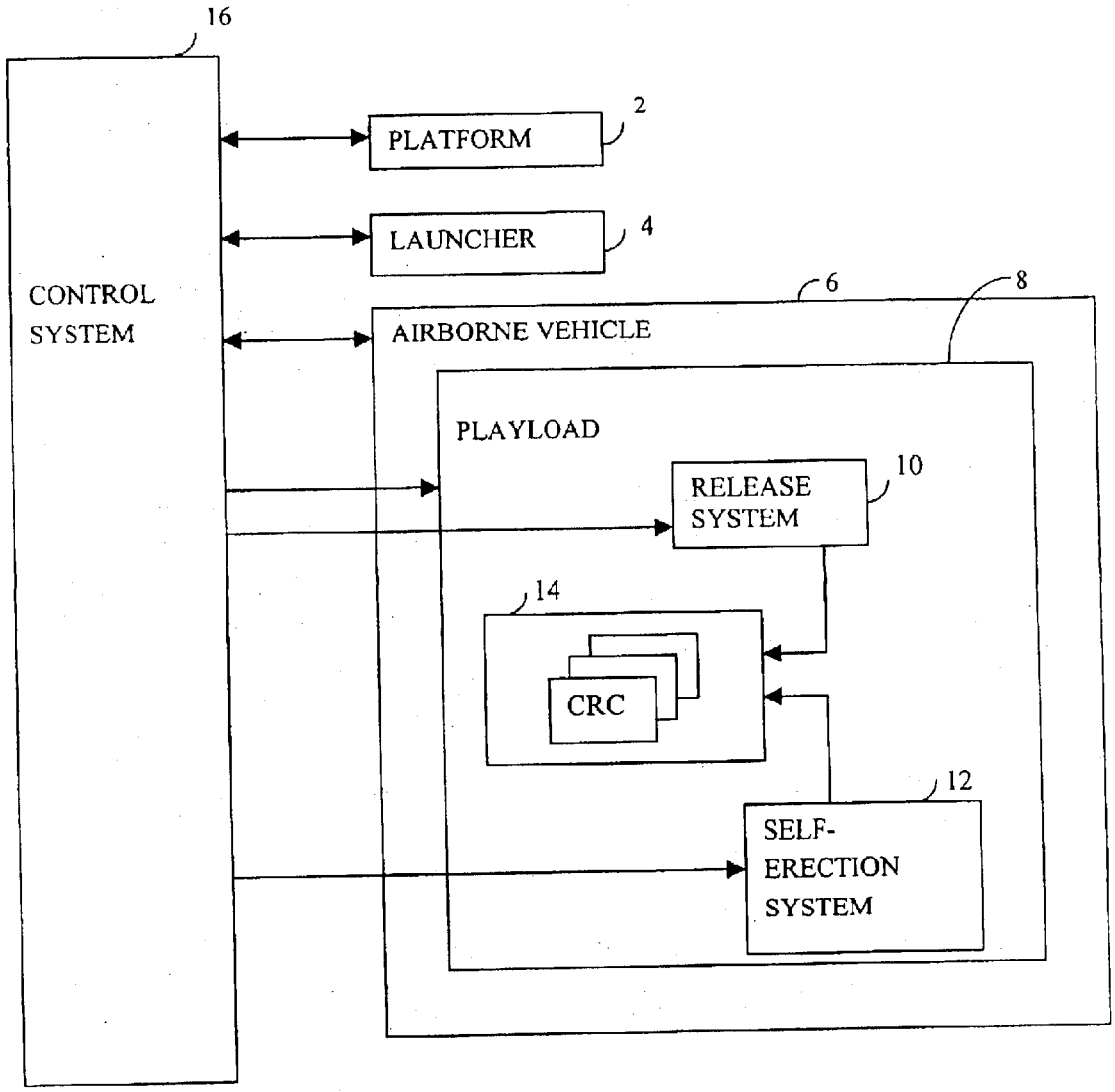
FIG. 1 is a block-diagram of a RCM, or Radar Counter-Measure.

FIG. 1 is a block diagram of the main components of the RCM. Platform 2 supports the launcher 4, which launches the airborne vehicle 6. In flight, there is operated a release system 10 and a self-erection system 12, for the release and self-erection of a single CRC 14 or of many CRCs. The Self-erection system deploys the released CRC 14 and starts operational functioning thereof.

The protection of a targeted platform 2 is efficiently effected at various ranges away from that platform, such as long, mid, and close range, thereby providing multiple lines of defense to the platform 2. The effectiveness of the RCM operating the above-described protection scheme, even in its crudest version, is a multifold when compared to a decoy set afloat to sea from a ship. The disclosed RCM is operative from a predetermined release altitude, at a release point above the sea level for example, which is reached quickly and precisely to effectively counter a potential danger.

For a better understanding of the benefits of the disclosed RCM and of the defense tactics related to lines of defense, practices commonly adopted by many navies are presented below.

It is noted that naval combat is regarded to consist of three stages designated as: locate, engage, and destroy. Anti-missile ship defense should fend off the enemy at all stages of naval combat by deceiving hostile search-and-fire control radars, as well as enemy missiles fired from ships, aircraft, helicopters, and submarines.

The following example deals with the protection of a targeted naval platform from the threat of incoming enemy missiles. Anti-missile defense includes three lines of defense.

I. Confusion: at long range, to prevent the enemy from locating the target.

II. Distraction: at medium range, to impede engagement.

III. Seduction: at short range, to deceive missiles and prevent the target's destruction.

I. Confusion is the first line of defense intended to prevent the enemy from locating targets, prior to any battle. The aim is to seed false information about the position and strength of the attacked party, as received on an enemy's search radar display. Confusion defense is used before the beginning an attack, when the targeted ship is distant and still below the enemy's radar horizon.

For confusion, CRCs are deployed at long-range, well within enemy radar detection range. Subsequently, the CRCs are detected by the enemy's search radar, on which they appear as legitimate targets. The CRCs mislead the enemy, which is enticed to fire missiles against these fake targets and thereby, depletes his supplies of ammunition.

Confusion defense is very effective against missile-armed airborne search platforms, such as aircraft or helicopters. For reasons inherent to fuel capacity and flight range limitations, the enemy usually launches missiles, or sends target position data, against the first target detected on radar, which in this case consists of the CRCs.

II. Distraction is the second line of defense, used to prevent the discovery of the targeted unit while the attacking missile cruises in search mode. When deployed at medium-range, the CRCs realistically simulate "targets", on which the missile seeker will "lock" and deviate from the real target.

Distraction defense is used during the actual engagement phase of the encounter, when the enemy has located the targeted ship and has launched missiles to destroy it. At this stage, the attacking missile is generally directed towards a "way point", where the seeker is activated to start searching for potential targets. The range of a "way point" is typically more than 20 km.

It is well known that sea clutter prevents an attacking missile from detecting a ship at long range. However, CRCs deployed outside that clutter, lure the seeker of the incoming missile by faking a genuine targets. In consequence, the missile locks on a CRCs and thereby, shields the attacked platform from danger. When CRCs are utilized for distraction, they provide effective protection even against a salvo of various threats attacking simultaneously from various directions.

III. Seduction is the "last ditch" line of defense, for use when a missile is locked on the target. The CRCs, featuring a huge RCS, attracts the missile and causes a trajectory deflection away from the attacked ship.

Seduction defense is used at short range, at the last stage of the encounter, against missiles posing an imminent threat. Typical range to threat spans from 5 to 10 km.

When deployed at short range, the CRCs simulate huge "targets". Thereby, once the attacked ship and the CRCs enter within the missile's range gate, the CRCs draw the seeker away and the missile surrenders the lock on the ship in favor of locking on the CRCs.

Referring to FIG. 1, the kind of platform 2 for support of the launcher 4, or launching system 4, is possibly ground-based, marine, or airborne. When ground-based, the platform 2 is either in static position, or mobile, as when mounted on a vehicle. Water going or airborne crafts are especially practical platforms 2.

The launcher 4 and the airborne vehicle 6 are mutually dependent and so is their relation to the platform 2. Practically, an airborne vehicle 6 is either a barrel-launched round of ammunition or a self-propelled body. The former pertains to artillery pieces, such as a mortar or a gun, firing, respectively, mortar bombs and gun shells. Self-propelled bodies are rockets for example, which are launched from a tube, a canister, or a rail.

With regard to launchers 4, it is recognized that an artillery piece, is a rather heavy piece of equipment that imparts a severe recoil shock to the supporting platform 2. Artillery is thus limited to ground based and large size marine platforms, which generally carry guns.

The columns of Table 1 summarize some features of airborne vehicles 6, launchers 4, and platforms 2. The rows of the same table, numbered from 1 to 3, refer to three different types of airborne vehicles 6, shaped as, respectively, a mortar bomb, launched from a mortar, a shell, fired from a gun, and a rocket taking off from a tube. The columns A to H of Table 1 provide comparative data related to various features, explained below in more detail.

TABLE 1

| | Airborne Vehicle 6 | | Launchers 4 | | | Launching Platform 2 | | |
|---|---|---|---|---|---|---|---|---|
| | A Type | B Price | C Kind | D Weight | E Recoil | F Ground | G Marine | H Airborne |
| 1 | Bomb | Low | Mortar | Heavy | High | + | + | − |
| 2 | Shell | Low | Gun | Heavy | High | + | + | − |
| 3 | Rocket | Medium | Tube | Light | None | + | + | + |

Price, in column B, is rather low for artillery ammunition and medium for rockets. Launcher weight, in column D, is comparatively heavy for artillery pieces relative to a launcher tube for a rocket. Recoil, in column E, is naturally high for artillery and practically nonexistent for rockets. Evidently, bombs and shells are generally fired from the ground and from marine platforms only, whereas rockets lift off almost any platform. Columns F to G compare the positive or negative feasibility of use of a platform 2, i.e. ground-based, marine, or airborne, for the kind of launcher, given in column C, relative to the type of airborne vehicle 6 found in column A.

It is appreciated that one platform 2 is capable of providing protection to one or more other platforms under expected or actual attack.

Launching systems and release systems for the various kinds of platforms considered are known to the art, and therefore, need not to be described.

Attention is now drawn to the control of the RCM. In FIG. 1 the control or control system(s) are symbolized by one generic controller 16, which represents the control architecture of a centralized controller, a distributed controller or a combination of both kinds of controllers. It is explained below that the controller shown in FIG. 1 are a mere abstract symbol, since the control of systems is well known in the art.

Any platform 2 is subject to control, and likewise are platforms such as ground, marine and airborne platforms. Ground platforms such as an artillery battery or a battle tank, are two examples of weapon system platforms. Both are controlled at different levels of operation, and the same is true for marine and airborne platforms, also representing weapon systems platforms.

The launcher 4, being a launching system, is possibly under command of a platform controller, which orients the launcher and fires the airborne vehicle 6 into trajectory. Evidently, the launcher 4 may have an independent launcher controller that is regarded as part of a distributed control system.

The airborne vehicle 6 is possibly equipped with an on-board controller or is controlled by a central controller or a distributed control system. Such controls manage the in-flight functions comprising commands for the release of the payload 8 and for the self-erection of at least one Corner Reflector Construction 14, or CRCs 14.

It is thus appreciated that the platform 2 is under control of a control system 16, also commanding the orientation of the launcher, or launching system, and the firing of the airborne vehicle 6. In turn, a vehicle controller controls the operation of the airborne vehicle 4 for the timely release, by the release system 10, and for the proper erection, by the self-erection system 12, of at least one CRC, packaged inside the payload B. The control of systems such as RCMs and their implementation as automatic or semi-automatic systems, for autonomous operation, is known to the art, and does not require further explanation.

The RCM is required to operate in quick reaction to an expected or to an incoming attack, and to provide a fast, cost-effective and successful response. The aim is to emplace an expendable point decoy, such as a Corner Reflector Construction, or CRC, at a predetermined point, at altitude in the sky, away from the intended target. The only solution to achieve the aim is to fire an expendable airborne vehicle carrying a CRC, foldable for transportabilty, for release when desired, and self-erecting operational deployment.

The CRC is a mechanical structure folded for stowage in a minimum volume payload for later firing in a mortar bomb, or in a shell, or in a self-propelled vehicle. After release, the CRC self-erects.

A mechanical structure configured for self-erection may take advantage of one, of many, or of a combination of physical properties allowing the storage of force for later use in the erection of the structure, when desired. For example, a resilient structure may be folded and constrained inside a container, to spring open and self-erect, under the effect of the inherent elastic forces, upon release from the container imposed constraints. Evidently, a foldable construction may be folded-up and cocked against a stressed spring mechanism, to achieve the same self-erecting effect. Another example of self-erection is a pliable inflatable structure, self-erecting under the application of inflation pressure. Other ways of providing self-erection forces on board the airborne vehicle 6 include pyrotechnic means, force derived from the release mechanism of the payload, or motor generated forces. A motor is either a motor propelling the airborne vehicle 6 or a motor on board thereof. The environment also permits the derivation of self-erection forces, such as inertia forces or aerodynamic forces. In fact, many forces or combination of forces may be employed for the self-erection of a CRC. A few embodiments will now be considered in more detail.

In the Figs. below, similar reference numerals refer to similar elements.

Figure 2:
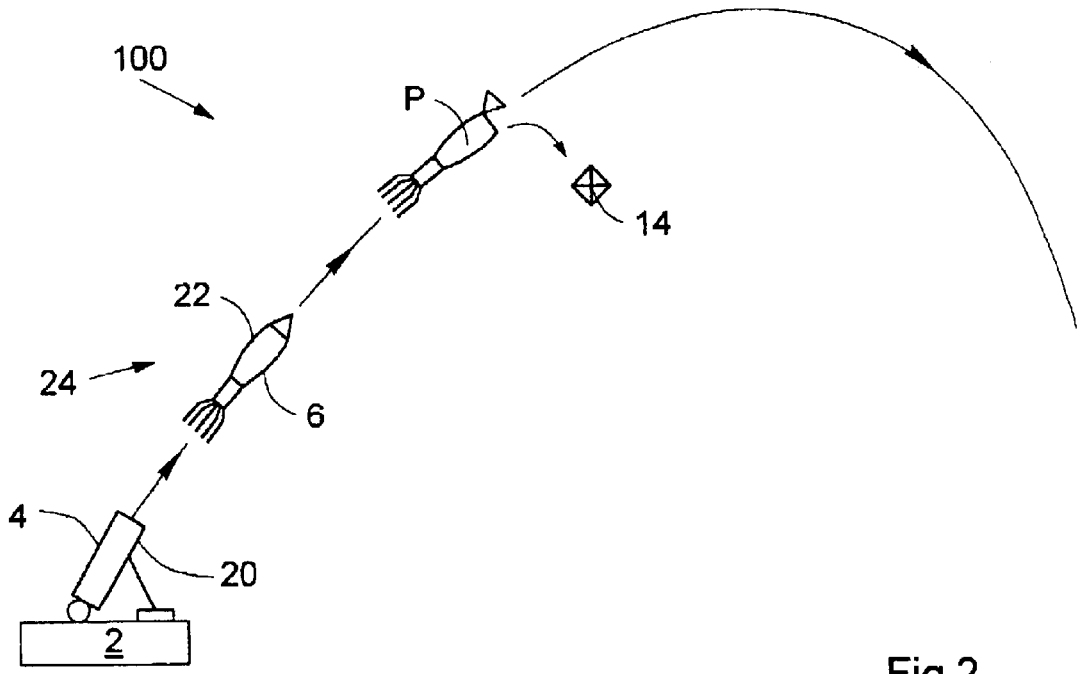
FIG. 2 diagrammatically depicts a mortar-launched embodiment of the RCM, following FIG. 1.

FIG. 2 depicts a first embodiment 100, and shows the various phases of operation of the RCM, from launch to CRC 14 operation. There is shown a platform 2, supporting a mortar 20, serving as a launcher 4, which fires a body 22 configured as a mortar bomb 24. Table 1 shows that mortars are limited for use only with ground and marine platforms. It is noted that there exist modern mortar systems, firing almost without recoil, but still of heavy weight, making them unsuitable for small boats and airborne crafts.

The body 22 accommodates a payload 8 comprising at least one CRC 14. In flight, the body 22 follows a high parabolic ballistic trajectory, typical for mortars, until commanded by a controller, to release the payload at a release point P. At that same release point P, or after a given interval, command is given for the self-erection of the CRC 14, which then begins to function.

It is appreciated that such a plain system, with a mortar being the launching system, may look deceptively a simple but provides superior protection performance to the platform 2. A platform 2 is possibly a ship possessing a central platform controller that may orient the barrel of the mortar 20 in appropriate azimuth and inclination relative to the nature and position of an incoming threat whose flight-path is known to the same platform controller. In contrast, it is also possible to consider a stand-alone mortar 20, oriented in azimuth by the course of the platform 2, perhaps with a manually adjusted elevation, or even with a fixed elevation.

The body 22 is commanded to release and erect a CRC 14 at a release point P predetermined by a controller. Again, the release, and sometimes the erection command, are possibly given by the platform controller, by wireless link to the body 22, or by other means. While in flight, the platform controller continuously monitors incoming enemy threats, and provides the airborne vehicle 6 with updates to the release system 10, regarding the release point P. On the other hand, a simple time fuze, adjusted by the platform controller or set manually, or even pre-set, may even well initiate the release system 10 and the self-erection system 12, to respectively, release and erect the CRC 14.

Release systems from mortar bombs are known to the art and therefore, need not to be described.

Many types of self-erecting structures may be implemented, as will be described in detail below.

When erected, the CRC 14 features a self-erected structure supporting at least one radar reflector. Preferably, the CRC 14 comprises eight radar reflectors.

The simple to implement embodiment 100 is a Quick Response system operable after the detection of an enemy menace or in expectation thereof.

A second barrel-launched embodiment 200, firing a shell from a gun, is similar to embodiment 100. The main difference with the previously described embodiment lies with the longer range achieved by a gun, and with the flatter trajectory of the shell. This embodiment is advantageous for platforms armed with guns, like ships. By Table 1, the embodiment 200 is restricted to land-based and marine platforms.

Figure 3:
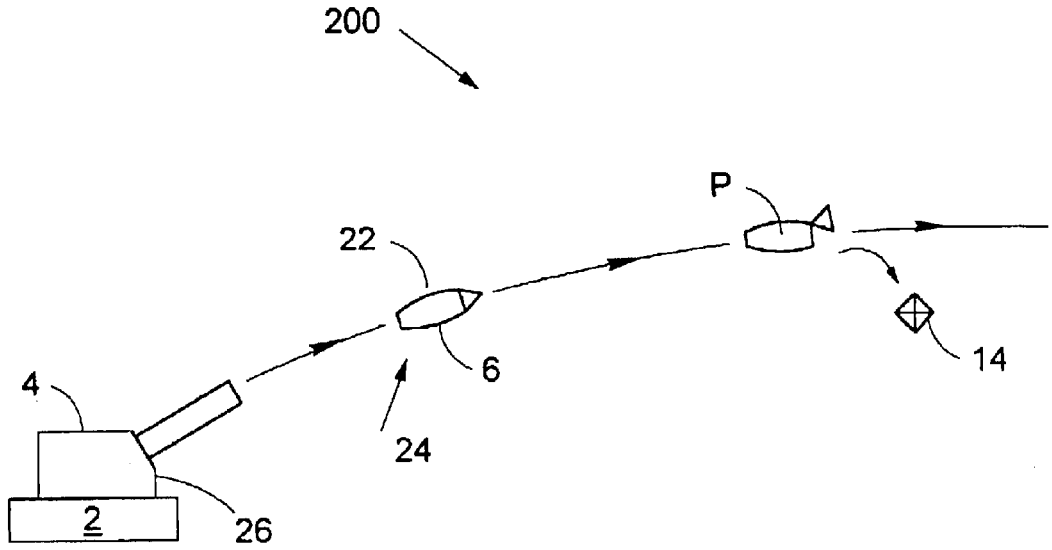
FIG. 3 illustrates, in diagram form, a gun-fired embodiment of the RCM, along the lines of FIG. 1.

In FIG. 3, the airborne vehicle 2, or the shell 24, accommodates a payload 8 comprising at least one CRC radar decoy 14. The fired shell 24 follows a ballistic trajectory, until commanded by a controller to release the payload at a release point P. It is thus at release point P, or shortly thereafter, that the CRC 14 is self-erected and begins to function.

On ships, guns are the launcher, and are generally controlled by a central or fire control system. Azimuth and elevation, of a single or of many launchers 4, are possibly derived from the fire control system or manually adjusted.

The shell 24 is commanded to release and erect a CRC 14 at a release point P predetermined by a controller. Again, the command is possibly given by the platform controller constantly monitoring the battle scene, via a wireless link coupled to the fired shell 24. Thereby, updates are provided to the release system 10 regarding the release point P. Evidently, a simple time fuze, adjusted by the platform controller or set manually, may initiate the release system 10 and self-erecting system 12 to respectively, release and erect the CRC 14.

For the embodiment 200, erection of the CRC 14 is enabled in the same manner as for the embodiment 100.

The straightforward Quick Response system of embodiment 200 is possibly activated after detection of an enemy threat, either expected or detected.

In a preferred embodiment 300, the above-described RCM comprises an airborne vehicle 6 configured as a rocket. In principle, any ballistic trajectory, either high or flat, may be imparted to such an airborne vehicle 6.

By Table 1, the embodiment 300 is preferred due to the many advantages offered. As opposed to barrel-launched ammunition, the platform 2 does not experience recoil forces caused by firing of a rocket. Furthermore, the embodiment 300 does not impose the weight of an artillery piece. Therefore, an RCM configured as embodiment 300, is practical for all kinds of launching platforms, even for lightweight platforms 2, such as small boats as well as for airborne platforms.

In addition, a launcher 4, according to the preferred embodiment 300, may comprise a multiplicity of launching tubes, wherefrom a salvo of rockets may be fired practically simultaneously, for deploying a curtain of CRC s 14 to deceive the enemy.

Still another benefit relies on the current availability of existing chaff rocket-launchers already installed on the majority of fighting ships. Evidently, modern weapon systems are not deceived by World War II chaff anymore, while a CRC 14, deployed in mid-air and carrying at least eight trihedral radar reflectors, poses a serious challenge to enemy attack weapons.

It is appreciated that rocket propelled airborne vehicles 6 sustain but low launch accelerations, as opposed to barrel-launched projectiles. Moreover, rocket propelled airborne vehicles 6 are aerodynamically fin-stabilized, and so are mortar launched projectiles, as opposed to shells that are spin stabilized. Therefore, at launch, a rocket-launched payload 8 is spared the high longitudinal acceleration, and in flight, the centrifugal acceleration imposed on a shell is non-existent. It is noted that such accelerations are of the order of magnitude of many thousand-folds of the acceleration of gravity. Low accelerations translate into low forces, which result in low structural strength being required for the payload 8, thereby enabling the implementation of a lightweight structure for the payload 8, for the CRC 14, and for other components of the payload.

Figure 4:
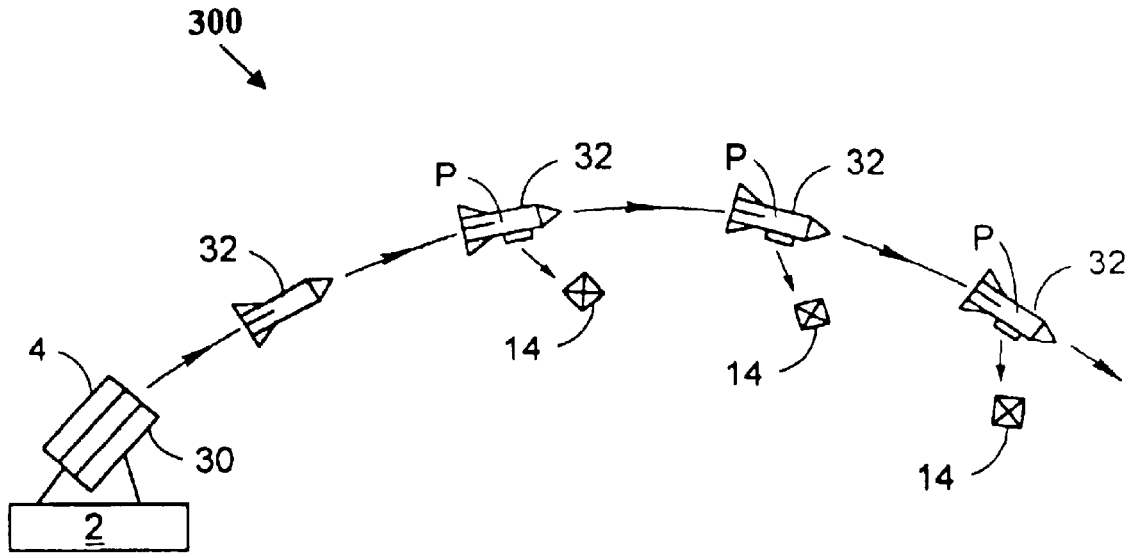
FIG. 4 shows a diagram of a rocket-propelled embodiment of the RCM, based on FIG. 1.

Referring to FIG. 4, a rocket-launcher 30, preferably a multi-tube launcher, fires the airborne vehicle 6, here a rocket 32, which is carrying a payload 8 comprising at least one CRC 14. The rocket 32 follows a predetermined flight trajectory, until a controller commands the release of at least one CRC 14 from the payload 8, at a predetermined release point P. It is thus at release point P that a CRC 14 is released and erected, immediately or after a interval, to start operational functioning.

The rocket launcher 30 is preferably configured as a multi-tube launcher, for firing controlled sequence salvo launches of rockets. The rocket launcher 30 may be controlled in azimuth and elevation, or remain fixed. It is appreciated that the launcher is possibly under command of a central platform controller, a weapons system controller, a launcher-dedicated controller, or any combination of central and local controllers.

Release mechanisms, to release a payload from a rocket, are well known and need not to be described. The command for release is given by any combination of controllers, as explained above.

The rocket 32 is commanded to release and erect at least one CRC 14 at a release point P predetermined by a controller. Again, the command is possibly given by the platform controller constantly monitoring the battle scene, via a wireless link to the rocket 32. Thereby, updates are provided to the release system 10 with last moment information regarding the preferred release point P. That release point P is chosen as a point defined either in space or in time, or in altitude. It is also possible to utilize a partially automatic controlled or completely manually controlled launcher 30.

Usually, the release point P is selected according to protection methods and warfare doctrines. The type and number of incoming targets are parameters in such decisions. It is understood that the release point P is a singular point where at least one CRC 14 is released. The release of a multiplicity of CRC s 14 may thus involve a single or a number of sequential release points P, comprising at least one single release point P or at most, as many release points P as the total number of CRC s carried by the payload 8.

The methods for the determination of the spatial position of a predetermined release point P in space are known to rank from simple triangulation to sophisticated GPS instrumentation.

Timing systems are also well known in the art. Timing is provided by controllers configured in centralized, distributed, or combined architectures. A simple time fuze, adjusted by the platform controller or set manually, may initiate the release system 10 and the self-erection system 12 to respectively, release and erect the at least one CRC 14, or a multiplicity thereof.

Release at a given release point P of altitude in known to the art, and implemented as simple barometric devices or as sophisticated electronic altitude measuring instruments of various kinds.

Many types of structures may be envisioned for a CRC, but all of those structures must be foldable to fit inside the rather small dimensions of the payload 8 in the airborne vehicle 6. Such structures may include resilient pliable structures, rigid but foldable structures, inflatable folded structures and a combination thereof.

Resilient structures are possibly built from resilient elements folded within the limits of the elastic range of the material. The resilient structure remains folded by a constraint, to spring open, thus self-erect, when that constraint is removed.

A rigid but foldable or collapsible structure may be erected by the application of an erection force. Such force or array of forces is applicable by resilient elements, such as springs, or by the force of a pyrotechnic element. Fluid force is applicable via a piston powered by fluid under pressure, like from a vessel of compressed gas, or compressed liquid, or from a gas generator, or from pressure derived from the aerodynamics of flight. Such aerodynamic force can result from simple ram air pressure, low pressure from the airflow surrounding the airborne vehicle 6 or even from a surface deployed in the airflow to provide drag force. Other on-board generated forces may be derived from a motor, such as a motor for the propulsion of the airborne vehicle 6 or any other motor on-board. The inertia of flight is still another source of force.

An inflatable foldable structure, also practical, requires a source of pressure for inflation. Examples count at least one gas generator, or vessels of compressed gas, or pressure derived from the engine of the rocket 32, or pressure derived from the aerodynamics of flight of the airborne vehicle 6, such a stagnation or ram air pressure.

A combination of the above-mentioned types of structure for a CRC is also possible, as well as a combination of forces for the erection thereof.

The embodiment 300 is thus capable of providing a Quick Response (QR) protection system for activation when an enemy threat is detected or expected. Preferably, the RCM is implemented as a "Fire and Forget" weapon system, controlled and operated automatically without requiring the attention of personnel after firing order is given.

It is appreciated that the same RCM provides multiple lines of defense by adjusting the range and/or the altitude of operation to the required combat need. Furthermore, one platform 2 is capable of launching protection for another remote platform 2, or for a plurality of platforms, such as for protecting a fleet at sea.

Without departing from the above invention, design changes can be made in construction of the RCM that in no way limits the scope of the above invention. For example, a single platform 2 may support a single or multiple launchers 4, of the same or of different kinds of launcher, to deliver more than one type of airborne vehicle 6. Moreover, the RCM may comprise the use of more than one kind of platform 2 to protect one or more platforms expected to be attacked, or, actually attacked by enemy fire.

While the invention has been described with respect to a limited number of embodiments, it will be appreciated that many variations, modifications, and other applications of the invention may be made. For example, the CRC 14 may be erected and released from a manned or unmanned airborne platform, such as an aircraft, serving as release vehicle, without being first fired or propelled. Furthermore, the payload 8 may comprise at least one CRC 14 and other objects for release, such as one or more different decoys. For example, Infra Red decoys may be comprised in the payload 8 together with CRC s 14. It is also appreciated that the airborne vehicle 6 is preferably of relatively low cost an expendable, but that a reusable vehicle is also practical.

It will be appreciated by persons skilled in the art, that the present invention is not limited to what has been particularly shown and described hereinabove. Rather, the scope of the present invention is defined by the appended claims and includes both combinations and subcombinations of the various features described hereinabove as well as variations and modifications thereof which would occur to persons skilled in the art upon reading the foregoing description.

What is claimed is:

1. A Radar Counter Measure System (RCMS) for protection against a threat operating in association with radar signals, the RCMS comprising:

a launching system mounted on a platform, an airborne vehicle launched in predetermined trajectory by the launching system, the airborne vehicle carrying a payload comprising at least one CRC (Corner Reflector Construction) that when deployed, is operationally effective for deception of the threat, the airborne vehicle comprising:

a release system for releasing the at least one CRC from the airborne vehicle at a predetermined point P, and a self-erection system for deploying the at least one CRC, and a control system comprising at least one controller, for management and operation of the RCMS, the control system being selected, alone and in combination, from the group consisting of centralized and distributed control systems.

2. The RCMS according to claim 1, wherein:

the at least one controller provides management and operation of airborne vehicle functions.

3. The RCMS according to any of the claims 1 and 2, wherein management and operation of functions of the airborne vehicle, of the release system and of the self-erection system are performed by at least one controller.

4. The RCMS according to claim 1, wherein:

the platform is selected from a group consisting of airborne, waterborne, and ground-borne platforms.

5. The RCMS according to claim 1, wherein the platform is a marine platform.

6. The RCMS according to claim 1, wherein the airborne vehicle is launched in either one of two launching modes comprising firing from an artillery piece and launching as a self-propelled vehicle, each of the two launching modes being controlled by the at least one controller.

7. The method according to claim 1 or 6, wherein the airborne vehicle is under control of the at least one controller and configured for launch by a rocket motor.

8. The RCMS according to claim 1, wherein:

each one of the at least one CRC is released, respectively, at one predetermined point P on the trajectory of the airborne vehicle under control of the at least one controller.

9. The RCMS according to claim 8, wherein:

the predetermined point P is selected under control of the at least one controller, alone and in combination, from the group consisting of points in space, points in time and points of altitude.

10. The RCMS according to claim 1, wherein:

the at least one CRC is released under control of the at least one controller, at one predetermined point P in time.

11. The RCMS according to claim 1, wherein:

the at least one CRC is configured to deploy under control of the at least one controller, by self-erection of at least one radar reflector to reflect radar signals.

12. The RCMS according to claim 1 or 11, wherein:

the at least one CRC provides a predetermined Radar Cross Section (RCS) when deployed.

13. The RCMS according to claim 1 or 12, wherein:

the at least one CRC comprises at least one multi-directional radar corner reflector.

14. The RCMS according to claim 13, wherein:

the multi-directional radar reflector comprises at least one trihedral radar corner reflector.

15. The RCMS according to claim 13 or 14, wherein:

the multi-directional radar reflector comprises eight trihedral radar corner reflectors.

16. The RCMS according to claim 1, wherein:

the at least one CRC self-erects by application of elastic forces inherent therewithin.

17. The RCMS according to claim 1, wherein:

the at least one CRC self-erects by application of inflation pressure.

18. The RCMS according to claim 1, wherein:

the at least one CRC self-erects by application of aerodynamic forces derived from the predetermined trajectory.

19. The RCMS according to claim 1, wherein:

the at least one CRC self-erects by application of forces derived on-board the airborne vehicle.

20. The RCMS according to claim 1, wherein:

the at least one CRC self-erects by application of forces derived from pyrotechnic means.

21. The RCMS according to claim 1, wherein:

the at least one CRC self-erects by application of forces derived from the release system.

22. The RCMS according to claim 1, wherein:

the at least one CRC self-erects by application of inertia forces.

23. The RCMS according to claim 1, wherein:

the at least one CRC self-erects by application of forces derived from the environment.

24. The RCMS according to any of the claims 16 to 23, wherein:

the at least one CRC self-erects by application of a combination of forces.

25. A method of operation of a Quick Response Counter Measure (QRCM) against an airborne radar threat, the method comprising the steps of:

detecting a radar-guided threat, responding to the detected threat by launching from a platform and into predetermined trajectory of an airborne vehicle comprising a payload with at least one CRC, that when self-erected, is configured for deception of the radar-guided threat, flying the payload to a predetermined point of release, releasing the at least one CRC from the airborne vehicle, deploying the at least one CRC to start deception, and managing and operating the QRCM by a control system comprising at least one controller selected, alone and in combination, from the group consisting of centralized and distributed control systems.

26. The method according to claim 25, wherein the at least one controller provides management and operation of airborne vehicle functions.

27. The method according to claim 25 or 26, wherein management and operation of functions of the airborne vehicle, of a payload release system and of a payload self-erection system are performed by at least one controller.

28. The method according to claim 25, wherein the platform comprises airborne, waterborne and ground-borne platforms.

29. The method according to claim 25, wherein the airborne vehicle is launched from a marine platform.

30. The method according to claim 25, wherein:

the airborne vehicle is launched in either one of two launching modes comprising firing from an artillery piece and launching as a self-propelled vehicle, each one of the two launching modes being controlled by the at least one controller.

31. The method according to claim 25 or 30, wherein the airborne vehicle is under control of the at least one controller and configured for launch by a rocket motor.

32. The method according to claim 25, further comprising the step of:

releasing each one of the at least one CRC, respectively, at one predetermined point P on the trajectory of the airborne vehicle under control of the at least one controller.

33. The method according to claim 25 or 32, further comprising the step of:

selecting the predetermined point P under control of the at least one controller, alone and in combination, from the group consisting of points in space, points in time and points of altitude.

34. The method according to claim 25, further comprising the step of:

releasing the at least one CRC under control of the at least one controller at one predetermined point P in time.

35. The method according to claim 25, further comprising the steps of:

configuring the at least one CRC to deploy under control of the at least one controller by self-erection of at least one radar reflector to reflect radar signals.

36. The method according to claim 25 or 35, further comprising the steps of:

configuring the at least one CRC to provide a predetermined Radar Cross Section (RCS) when deployed.

37. The method according to claim 25 or 36, further comprising the steps of:

configuring the at least one CRC to comprise at least one multi-directional radar corner reflector.

38. The method according to claim 37, further comprising the steps of:

configuring the multi-directional radar reflector to comprise at least one trihedral radar corner reflector.

39. The method according to claim 37 or 38, further comprising the steps of:

configuring the multi-directional radar reflector to comprise eight trihedral radar corner reflectors.

40. The method according to claim 25, further-comprising the steps of:

self-erecting the at least one CRC by application of elastic forces inherent therewithin.

41. The method according to claim 25, further comprising the step of:

self-erecting the at least one CRC by application of inflation pressure.

42. The method according to claim 25, further comprising the step of:

self-erecting the at least one CRC by aerodynamic forces derived from the predetermined trajectory.

43. The method according to claim 25, further comprising the step of:

self-erecting the at least one CRC by application of forces derived on-board the airborne vehicle.

44. The method according to claim 25, further comprising the step of:

self-erecting the at least one CRC by application of forces derived from pyrotechnic means.

45. The method according to claim 25, further comprising the step of:

self-erecting the at least one CRC by application of forces derived from a release system.

46. The method according to claim 25, further comprising the step of:

self-erecting the at least one CRC by application of inertia forces.

47. The method according to claim 25, further comprising the step of:

self-erecting the at least one CRC by application of forces derived from the environment.

48. The method according to any one of the claims 40 to 47, further comprising the step of:

self-erecting the at least one CRC by application of a combination of forces.

* * * * *